US005131332A

United States Patent [19]

Smith

[11] Patent Number: 5,131,332

[45] Date of Patent: Jul. 21, 1992

[54] RAILWAY TRUCK WITH STEERED AXLES AND PRIMARY SUSPENSION

[75] Inventor: Roy E. Smith, Kingston, Canada

[73] Assignee: UTDC Inc., Kingston, Canada

[21] Appl. No.: 540,437

[22] Filed: Jun. 19, 1990

[30] Foreign Application Priority Data

Sep. 27, 1989 [CA] Canada ..... 613576

[51] Int. Cl.[5] ..... B61F 5/00

[52] U.S. Cl. ..... 105/224.05; 105/218.1; 105/168

[58] Field of Search ..... 105/218.1, 219, 222, 105/224.05, 224.06, 224.1, 223, 165, 167, 168, 453

[56] References Cited

U.S. PATENT DOCUMENTS 3,841,232 10/1974 Hess ..... 105/224.05
4,170,179 10/1979 Vogel ..... 105/168
4,699,065 10/1987 Kibble ..... 105/224.05 X

FOREIGN PATENT DOCUMENTS 1083886 8/1980 Canada ..... 105/55

*Primary Examiner*—Douglas C. Butler
*Assistant Examiner*—Kevin D. Rutherford
*Attorney, Agent, or Firm*—Rogers, Bereskin & Parr

[57] ABSTRACT

A railway truck for a railway vehicle which has steerable axles has axle bearings supported by support pedestals. Each support pedestal is located longitudinally by a flexible bar element which aallows the pedestal sufficient vertical movement to accommodate varying load conditions and also allows rotation about a horizontal axis which is not coincident with the axle bearings but restrains horizontal movement fore and aft of the rotational axis. A steering assembly reacting to relative rotational movements between the truck and the vehicle permits pivoting of the support pedestals about the horizontal axis. The tipping of the pedestal moves the axle bearing in the fore and aft direction which effectively rotates the axle about a vertical axis so as to guide the axle of the railway truck into radial alignment with respect to a curved track. The structure has the effect of an "inverted" pendulum, that is a pendulum with negative restoring force. The negative rotational stiffness of the support pedestals arising from the location of their pivotal axes is offset by positive forces exerted by suitably located vehicle support springs against spring supports on the pedestals.

13 Claims, 2 Drawing Sheets

RAILWAY TRUCK WITH STEERED AXLES AND PRIMARY SUSPENSION

FIELD OF THE INVENTION

This invention relates to railway trucks for railway vehicles and more particularly to railway trucks having steerable axles.

BACKGROUND OF THE INVENTION

A railway vehicle typically has axles mounted in pairs in the form of a truck at each end of the railway vehicle. These trucks typically pivot about a vertical axis of the truck intermediate the two axles and relative to the vehicle body. When the vehicle traverses a curve, the vehicle chords across the curve from truck axis to truck axis. If the wheels are not radially aligned on a curve, then the wheels are subject to increased noise and wear. Many mechanisms have been developed to steer such axles to a radial alignment.

Typically the wheels and axle of a railway truck are of unitary construction called a wheelset and the axil is mounted in bearings toward either end. A problem of steering the axles of a railway truck s to provide for transfer of support load from the axle bearing housing into the railway vehicle structure without constraining the horizontal motions required for steering.

Some prior designs have unutilized sliding elements or elastic members which shear in the horizontal plane to allow steering motions of the axles. These designs have the disadvantages that they introduce forces into the steering mechanism and are subject to wear. Canadian Patent No. 1,083,886 overcomes this problem by providing for horizontal motions through a pivoted element. A drawback to this design is that if it is desired to provide substantial vertical motion, the design becomes quite complicated by the addition of the required springs and guides.

U.S. Pat. No. 4,170,179 to Vogel describes a steering apparatus for rail vehicles utilizing two pairs of guide rods which pivotally attach to the bearing housings at diametrically opposed points. In Vogel, a pair of springs extends between the bearing housings and the railway truck frame. In Vogel, one of the guide rods extends between the truck frame and a first pivotal connection on the bearing housing. The other guide rod connects the bearing housing to the vehicle body either directly or through an intermediate linkage. Relative longitudinal movement between the truck frame and the vehicle body is transmitted to the bearing housing through the latter guide rod. This longitudinal movement causes rotation of the bearing housing about the first pivotal connection, which results in longitudinal movement of the end of the wheelset mounted therein.

In the illustrations in Vogel, the first pivotal connection is shown as being beneath the outer spring of the pair of support springs rather than above the center line of the wheelset. Rotation of the bearing housing will therefore result in raising or lowering of the bearing housing depending on the direction of rotation. As both ends of a given wheelset are moved in opposite directions by the steering mechanism, steering input into the device of Vogel will cause one end of the wheelset to be raised relative to the truck frame and the other to be lowered.

Another drawback to the structure of Vogel is that it does not balance the weight of the railway vehicle against the forces generated by steering input to reduce the amount of steering force required and backlash generated.

SUMMARY OF THE INVENTION

This invention provides a support pedestal for housing each wheel bearing. The support pedestals are tiltable to cause fore and aft movement of the bearings and correspondingly the ends of the axles, to steer the axles. The centre about which the pedestal pivots remains between the center lines of the suspension springs.

More particularly, this invention provides a suspension apparatus for a truck for a railway vehicle, with the truck having a frame and at least one wheelset supporting the frame. The truck is mounted to the vehicle to permit relative rotation between the truck and the vehicle. The suspension apparatus comprises an axle bearing for supporting the axle of the wheelset and a pedestal mounting the bearing. The pedestal has at least one spring support for supporting a pair of vertical support springs extending between the spring support and the truck frame. One of the pair of support springs has a center line through which its force acts ahead of the center line of the axle. The other of the pair of support springs has a center line through which its force acts behind the center line of the axle. A pedestal locator is provided for locating the pedestal with respect to the truck frame, the pedestal locator permitting pivotal movement of the pedestal about a generally horizontal axis. The pedestal locator attaches to the pedestal between the center lines through which the respective forces of the pair of support springs act. A steering link is pivotally connected to the pedestal and linked to the vehicle so that upon relative rotation of the truck with respect to the vehicle when travelling on curved track, the steering link will cause the pivotal movement of the pedestal so that the wheelset will be guided to a radial alignment in respect of the curved track.

BRIEF DESCRIPTION OF THE DRAWINGS

Reference will now be made to the accompanying drawings which illustrate a preferred embodiment of the invention by way of example, and in which.

DESCRIPTION OF THE PREFERRED EMBODIMENTS

Figure 1:
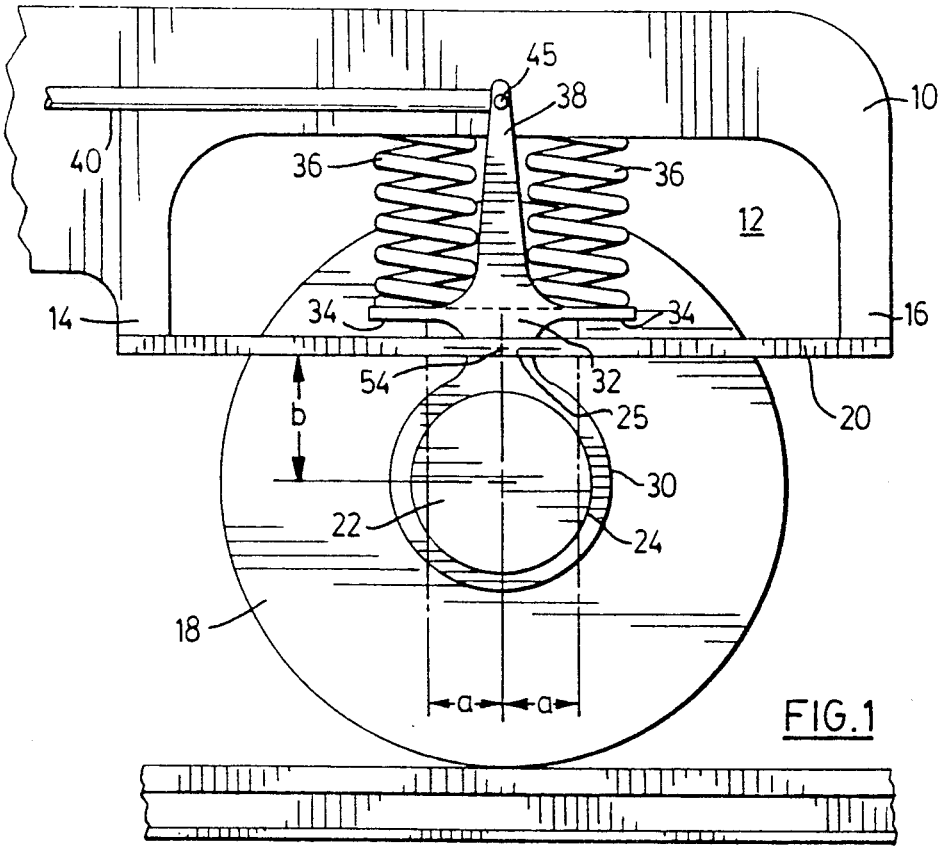
FIG. 1 is a side view of one end of a railway truck showing the end of a wheelset and the suspension apparatus in the position for negotiating tangent track.

FIG. 1 shows a side view of a preferred embodiment of a suspension apparatus in accordance with the invention. FIG. 1 only shows one end of one wheelset and its suspension apparatus. The opposite end of that wheelset and its suspension apparatus and the ends of the remaining wheelsets and suspension apparatuses would be similar. The wheelset 18 comprises an axle 22 and a wheel 23.

The end of the railway truck frame 10 is shown as having a recess 12 giving the end of the truck frame 10 a generally inverted U-shaped profile having downwardly depending ends 14 and 16. Pedestal locator 20, which is a generally rectangular flexible bar element, extends across and attaches to downwardly depending ends 14 and 16.

Figure 2:
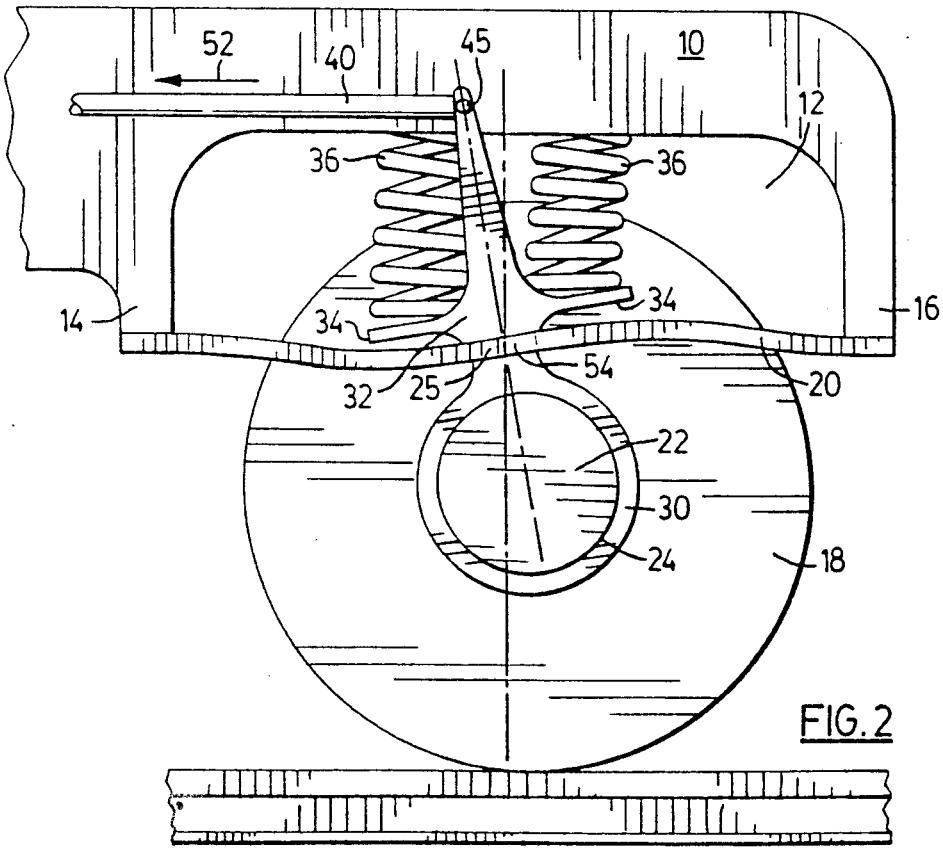
FIG. 2 is a side view of the truck of FIG. 1 showing the suspension apparatus in the steered position for negotiating curved track.

The end of the axle 22 of the wheelset 18 is shown as being supported in a bearing 24. The bearing 24 is mounted in a pedestal 30. The pedestal 30 has an upwardly projecting column 32 extending through the pedestal locator 20. The pedestal 30 rigidly attaches to the pedestal locator 20 at the region of intersection 25 at a distance b above the axle. A vertical extension 38 is shown as projecting upwardly from the column 32 away from the region of intersection 25. The vertical extension may be upwardly as shown in FIGS. 1, 2 and 4 or downwardly as shown in FIG. 3.

Two spring supports 34 project from the upwardly projecting column 32 at right angles thereto. One of spring supports 34 projects fore and the other aft of the upwardly projecting column 32. Vertical support springs 36 extend between the spring supports 34 and the truck frame 10.

Figure 4:
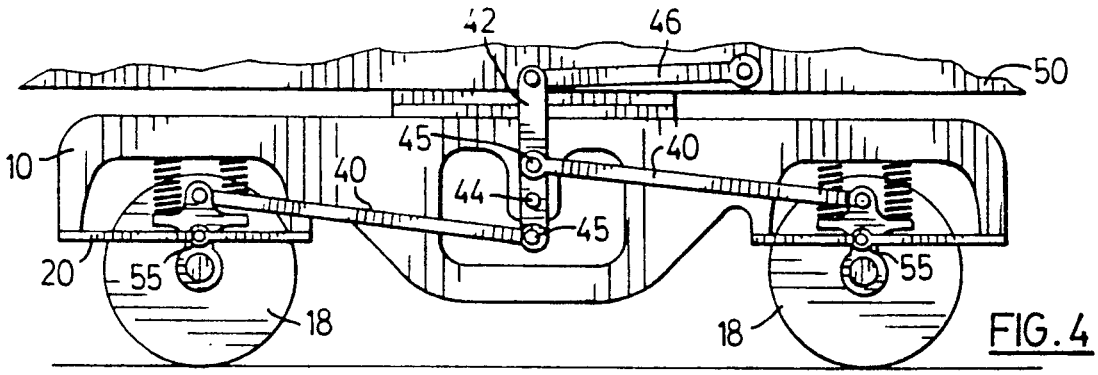
FIG. 4 is a side view of a railway truck similar to FIG. 3 but showing an alternate embodiment for mounting the steering links.
Figure 5:
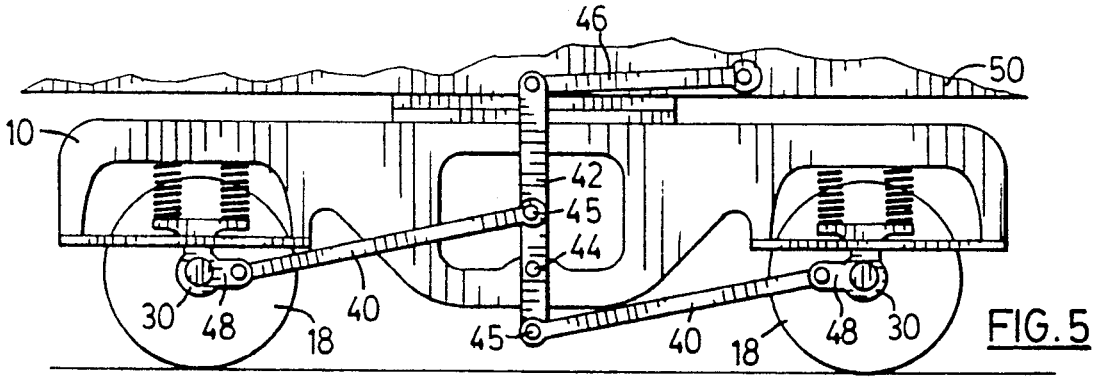
FIG. 5 a side view of a railway truck similar to FIGS. 3 and 4 but showing yet another embodiment for mounting the steering links.

The railway vehicle 50 surmounts the truck frame 10 and is mounted so as to permit relative rotation between the railway vehicle 50 and the truck frame 10 about a vertical axis passing through the center line of the truck frame. FIGS. 3, 4 and 5 show typical arrangements for causing relative rotational movement between the vehicle 50 and truck frame 10 to result in relative longitudinal displacement of a steering link 40 which pivotally attaches to the pedestal 30. Steering link 40 may be a rigid bar or rod.

Figure 3:
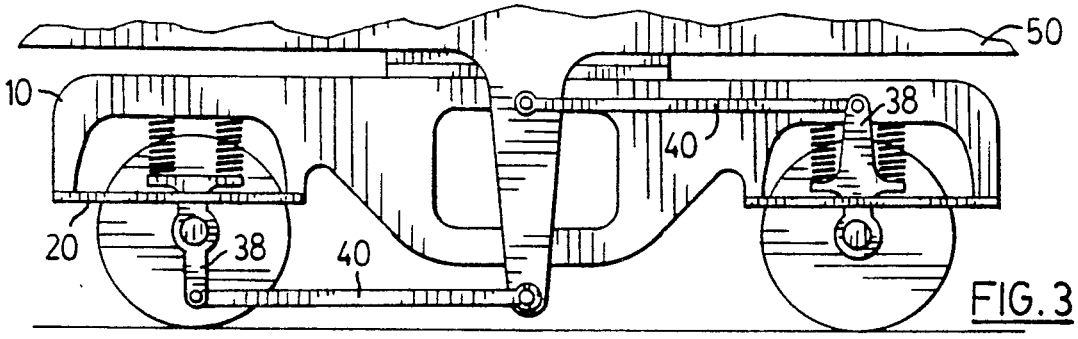
FIG. 3 is a side view of a railway truck underneath a section of a railway vehicle and showing steering links between the pedestal and the vehicle body.

FIG. 3 shows a steering link 40 pivotally attached at one end to the vertical extension 38, and at the opposite end to the railway vehicle 50.

FIG. 4 shows an alternate embodiment wherein the steering link 40 from either wheelset 18 is pivotally connected to an interim link 42 at points 45. The interim link 42 is pivotally attached to the truck frame 10 at a pivotal attachment point 44 which is between the points 45. This provides opposite lateral movement of the two steering links 40. The interim link 42 extends upward from the points 45 and the pivotal attachment point 44. A transmitting link 46 pivotally attaches to the upper end of the interim link 42 and to the railway vehicle 50.

FIG. 5 shows yet another embodiment similar to that shown in FIG. 4 except that the pedestal 30 is provided with a horizontal extension 48 rather than a vertical extension. Horizontal extension 48 extends horizontally from pedestal 30 toward interim link 42. The steering links 40 are pivotally attached to the horizontal extensions 48.

Referring to FIG. 2, it can be seen that lateral displacement of the steering link 40 in the direction indicated by the arrow 52 will displace the pivotal attachment point 45 of the steering link 40 to pedestal 30 in the same direction. Such displacement of the pivotal attachment point 45 will tilt the pedestal 30 about a horizontal axis 54 perpendicular to the plane of FIG. 2. The horizontal axis 54 is coincident with the attachment region 25. Tilting of the pedestal 30 will cause a slightly S-shaped deformation of the pedestal locator 20 as shown in FIG. 2. As the horizontal axis 54 is above the axis of the axle 22, tilting of the pedestal about the horizontal axis 54 will, depending on the direction of tilting, cause longitudinal displacement either fore or aft of the end of the axle 22. In this arrangement, the pedestal may be considered to be pivoting about a virtual pivot axis corresponding to the horizontal axis 54 as little or no actual relative movement takes place between the pedestal 30 and the pedestal locator 20 in the attachment region 25.

Alternatively, the pedestal locator can be pivotally attached to the pedestal to enable pivotal movement of the pedestal relative to the pedestal locator when the pedestal is tilted about an actual pivot axis corresponding to the horizontal axis 54. Such an arrangement is shown at reference 55 in FIG. 4.

It will be appreciated that the flexible bar material selected for pedestal locator 20 must possess adequate length and elasticity that the required deformation will be within the elastic range of the flexible bar. As it is desirable to also permit some vertical movement of the pedestal 30 to accommodate varying loads and such vertical movement will also require elongation of the pedestal locator 20, this amount of movement should also be taken into account when selecting the flexible bar material.

As the pedestal locator 20 is rigidly attached to the truck frame 10 at the depending ends 14 and 16, and the upwardly projecting column 32 of the pedestal 30 is rigidly attached to the pedestal locator 20, it will be appreciated that the pedestal is restrained from movement longitudinally and laterally with respect to truck frame 10 at the region 25 and at coincident axis 54.

When the above suspension apparatus is used for a truck for a railway vehicle and the steering links 40 are linked to the vehicle as described above, the suspension apparatus has the effect of guiding the wheels into radial alignment on a curve. As a railway vehicle traverses a curve, the vehicle will chord across the curve between the rotational axes about which the railway trucks 10 rotate with respect to vehicle 50. This rotation will cause lateral movement in the steering links 40 as described above and will accordingly, as also described above, cause longitudinal movement of the end of the axles 22 either toward each other on the inside radius of the curve or away from each other on the outside radius of a curve.

As most or all of the weight of the truck frame and railway vehicle would typically be supported by vertical support springs 36, the pedestal locator need only be sized to longitudinally locate the horizontal axis 54 of the pedestal. This minimizes the necessary size of the pedestal locator 20 and thereby minimizes its resistance to flexion about the horizontal axis 54.

Figure 6:
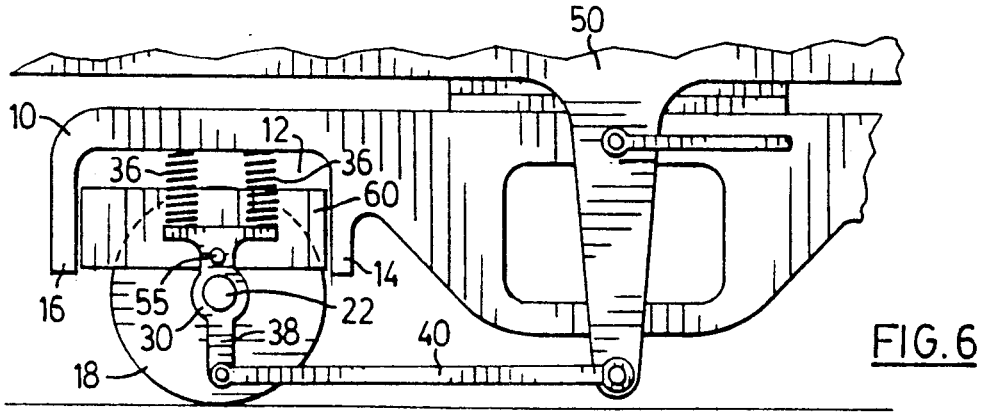
FIG. 6 a side view of part of a railway truck showing an alternate embodiment of a pedestal locator according to the present invention.

FIG. 6 shows an alternate embodiment of a pedestal locator identified by reference 60. The pedestal locator 60 is a block extending across the recess 12 of the truck frame and vertically slidable along the sides of the inverted U-shaped end of the truck frame 10. The pedestal 30 is pivotally attached to the pedestal locator 60 at 55 by means such as bolting. Pedestal locator 60 varies from pedestal locator 20 of FIGS. 1 and 2 in that it allows vertical movement of the pedestal 30 without requiring deformation of the pedestal locator 60.

Pedestal locator 60 is restrained from relative longitudinal movement between it and the truck frame 10 by the sides of the inverted U-shaped end of the truck 10. Lateral movement of the pedestal locator 60 may be prevented by suitable guide means (not shown) between the pedestal locator 60 and the sides of the inverted U-shaped end of the truck 10.

As the axis of the axles 22 is below the horizontal axis 54 about which the pedestal 30 pivots, the pedestal 30 is in effect an inverted pendulum. This arrangement has negative stiffness in that if the end of the axle is moved either fore or aft of the horizontal axis 54, the weight supported by the axle causes a moment about the horizontal axis 54 in the same direction as caused by the lateral displacement of the end of the axle rather than providing a restoring force in the opposite direction. If this negative stiffness is not otherwise resisted and controlled, the steering link 40, interim link 42, transmitting link 46 and their respective pivot points must be of adequately robust construction to withstand and control these forces. This is undesirable both in that the requisite steering effort with this arrangement would be substantial and any free play in the pivotal attachment points would generate backlash.

The placement of vertical support springs 36 relative to the horizontal axis 54 can be utilized to resist and control the negative stiffness of the pedestal arrangement. One such manner of controlling the negative stiffness is illustrated in FIG. 1. In FIG. 1, one of two equal stiffness vertical support springs is placed fore and the other an equal distance aft of the horizontal axis 54. In this arrangement, the vertical support springs 36 exert equal forces against the spring supports 34 fore and aft of the horizontal axis 54. The forces exerted by the vertical support springs 36 cause equal but opposite moments about the horizontal axis 54 when the suspension apparatus is in the position for negotiating tangent track. As shown in FIG. 2, tilting of the pedestal 30 about horizontal axis 54 causes one of the vertical support springs 36 to compress and the other to expand. As the force exerted by a spring relates directly to the amount by which it is compressed, it will be appreciated that the vertical support spring 36, on the side of the horizontal axis 54 toward which the end of the wheelset is displaced, will exert a greater force against the spring support 34 than will the vertical support spring 36 on the opposite side of the horizontal axis 54. These differences in the forces exerted by the vertical support springs 36, when the pedestal 30 is tilted, provide a net restoring couple urging the pedestal away from the tilted position.

If the restoring couple provided by the location of the vertical support springs 26 is too great, the forces required to tilt the pedestal can become undesirably high. It is desirable therefore to locate the vertical support springs 36 so that the restoring couple provided by the spring location is just slightly greater than the negative stiffness of the inverted pendulum arrangement of the pedestal 30. The effective stiffness ($K_e$) of this arrangement can be approximated by the expression:

$$K_e = K_v(a/b)^2 + K_B$$

"a" is shown in FIG. 1 as the distance between the horizontal axis 54 and the center line through which the force of the vertical support springs 36 acts. "b" is the height from the center of the bearing to the horizontal axis 54 "$K_v$" is the total vertical stiffness for the suspension assembly. $K_B$ is the bending stiffness of the springs.

If the effective stiffness is zero, then the moment caused by the restoring couple is equal but opposite to the moment caused by the negative stiffness. If the effective stiffness is greater than zero, then the moment caused by the restoring couple exceeds the moment caused by the negative stiffness. As the bending stiffness of a coil spring is very small compared to its longitudinal stiffness, the value of $K_B$ in the above formula for effective stiffness can be disregarded.

While the above expression is useful in describing the effective stiffness of the inverted pendulum arrangement of the pedestal 30, for design purposes it is helpful to express the dimension "a" in terms of the other design parameters which must be met in applying the suspension apparatus of this invention to a particular railway truck. One such parameter is of course the weight which the suspension apparatus is to carry. To achieve a negative stiffness approximately equal to zero for a suspension apparatus upon which it is intended to carry a weight "W", the following relationship must be satisfied:

$$a^2 = \frac{Wb}{K_v}$$

If the value of $a^2$ exceeds this amount, then the effective stiffness will be greater than zero.

It is to be understood that what has been described are preferred embodiments of the invention and it is possible to make variations while staying within the scope of the invention.

I claim:

1. A suspension apparatus for a truck for a railway vehicle, said truck having a frame and at least one wheelset supporting said frame, said truck mounted to said vehicle to permit relative rotation between said truck and said vehicle, said apparatus comprising;

an axle bearing for supporting the axle of said wheelset;

a pedestal mounting said bearing;

said pedestal having at least one spring support for supporting a pair of vertical support springs extending between said spring support and said truck frame, one of the pair of support springs having a center line through which its force acts ahead of the center line of said axle and the other of said pair of support springs having a center line through which its force acts behind said center line of said axle;

a pedestal locator connected to the truck frame and to the pedestal for locating said pedestal with respect to said truck frame said pedestal locator permitting pivotal movement of said pedestal about a generally horizontal axis of rotation of said pedestal and said pedestal locator, said axis being located between said center lines through which the respective forces of said pair of support springs act; said pedestal locator inhibiting longitudinal movement of said axis relative to said truck frame; and a steering link pivotally connected to said pedestal and linked to said vehicle so that upon relative rotation of said truck with respect to said vehicle when travelling on curved track, said steering link will cause said pivotal movement of said pedestal so that said wheelset will be guided to a radial alignment in respect of said curved track.

2. The apparatus of claim 1 wherein said pedestal locator permits vertical movement of said pedestal relative to said truck frame and inhibits longitudinal and lateral movement of said pedestal relative to said truck frame.

3. The apparatus of claim 2 wherein said generally horizontal axis is above said axle bearing so that said pedestal has a negative stiffness about said horizontal axis and, to give positive stiffness about said horizontal axis, said vertical support springs are located fore and aft of said horizontal axis, and the effective stiffness of said pedestal for pivotal movement about said axis is the sum of said negative stiffness and said positive stiffness of said vertical support springs.

4. The apparatus of claim 3 wherein said effective stiffness is not negative.

5. The apparatus of claim 4 wherein said pedestal further comprises an extension extending away from the axis of pivotal movement of said pedestal and said steering link is pivotally connected to said extension.

6. The apparatus of claims 2, 3 or 5 wherein said pedestal locator comprises a flexible bar.

7. The apparatus of claim 6 in which said steering link is pivotally connected to said vehicle.

8. The apparatus of claim 6 in which said steering link is pivotally connected to an interim link pivotally connected to said frame and said interim link is pivotally connected to a transmitting link.

9. The apparatus of claim 6 in which said steering link is pivotally connected to an interim link pivotally connected to said frame and said interim link is pivotally connected to a transmitting link, said transmitting link being pivotally connected to said railway vehicle.

10. The apparatus of claims 2, 3 or 5 wherein said frame of said truck has a recess above said wheelset and said pedestal locator comprises a block generally vertically slidable within said recess.

11. The apparatus of claim 10 wherein said steering link is pivotally connected to said vehicle.

12. The apparatus of claim 10 wherein said steering link is pivotally connected to an interim link pivotally connected to said frame and said interim link is connected to a transmitting link.

13. The apparatus of claim 10 wherein said steering link is pivotally connected to an interim link pivotally connected to said frame and said interim link is pivotally connected to a transmitting link, said transmitting link being pivotally connected to said vehicle.

* * * * *